United States Patent [19]

Schulkin

[11] Patent Number: 4,911,437

[45] Date of Patent: Mar. 27, 1990

[54] EXERCISE APPARATUS

[76] Inventor: William V. Schulkin, 56 Iselin Ter., Larchmont, N.Y. 10538

[21] Appl. No.: 308,100

[22] Filed: Feb. 8, 1989

[51] Int. Cl.[4] ..... A63B 21/02

[52] U.S. Cl. ..... 272/137; 272/141; 272/143

[58] Field of Search ..... 272/67, 68, 70, 114, 272/135, 137, 139, 141, 93, 109, 143; 36/7, 8

[56] References Cited

U.S. PATENT DOCUMENTS

| | | | |
|---|---|---|---|
| 1,487,631 | 3/1924 | Wanger | 272/68 |
| 2,022,002 | 11/1935 | Jacks | 272/137 |
| 2,494,094 | 1/1950 | Horstman | 272/136 |
| 3,228,392 | 1/1966 | Speyer | 272/137 X |
| 4,660,299 | 4/1987 | Omilusik | 272/114 X |
| 4,711,445 | 12/1987 | Whitehead | 272/67 |
| 4,775,148 | 10/1988 | McLaughlin | 272/139 |

FOREIGN PATENT DOCUMENTS

| | | | |
|---|---|---|---|
| 650754 | 10/1962 | Canada | 272/114 |

*Primary Examiner*—Richard J. Apley
*Assistant Examiner*—D. F. Crosby
*Attorney, Agent, or Firm*—Schweitzer & Cornman

[57] ABSTRACT

An exercise apparatus comprising a pair of hand-engageable, spring-biased exercise units, each comprising: a thermoplastic base element in the form of a frustoconical dish; a thermoplastic cap element having a dome-shaped hand-engaging surface; said base element includes a non-skid surface adhered to the bottom thereof; a steel coil spring secured between said base member and said cap member; and a hand strap traversing said cap member and being secured to peripheral edges thereof whereby said exercise device will support the arms of an exerciser during exercising and will provide a bouncing force to said exerciser upon the periodic compression and return of said coil spring.

4 Claims, 1 Drawing Sheet

EXERCISE APPARATUS

BACKGROUND AND SUMMARY OF THE INVENTION

Spring-biased exercise devices have long been known to the art for use in exercising and in developing various muscles and muscle tone in the body of the user. Representative of simple exercise devices of this general category are those shown in U.S. Pat. Nos.: 4,248,421; 4,211,404; 2,494,094; 2,132,862; and, 2,106,994.

None of the devices in the prior art is directed to apparatus for enhancing the benefits of push-up type exercise, that is, exercise in which the weight of the body is supported on the arms of the user, in whole or in part.

The new exercise apparatus of the invention comprises a pair of identical biased hand-engageable, body-supporting exercise units for enhancing the performance of push-up type exercises, i.e., exercises in which the substantially prone exerciser with his feet out straight and his torso in a plane with his feet, supports the weight of his body through his rigid arms with his toes engaging the floor.

In accordance with the present invention, the new and improved exercise device provides additional return and elevating thrust to the body of the user through the spring force of each unit as it returns from compressed to uncompressed condition as the user pushes down and then permits the spring force of the unit to assist in his return to an elevated position with regard to the floor. The new exercise apparatus provides a unique bouncing motion to the otherwise slow, tedious, and routine motion of conventional push-up exercises resulting in a new and improved workout and muscle development for the arms, shoulders, stomach, chest, indeed, the entire body, as contrasted with what was obtainable heretofore from conventional push-up exercise.

For a more and complete understanding of the apparatus of the present invention, and a better appreciation of its attendant advantages, reference should be made to the appended drawings taken in conjunction with the following detailed description of the invention.

DETAILED DESCRIPTION OF THE INVENTION

Figure 1:
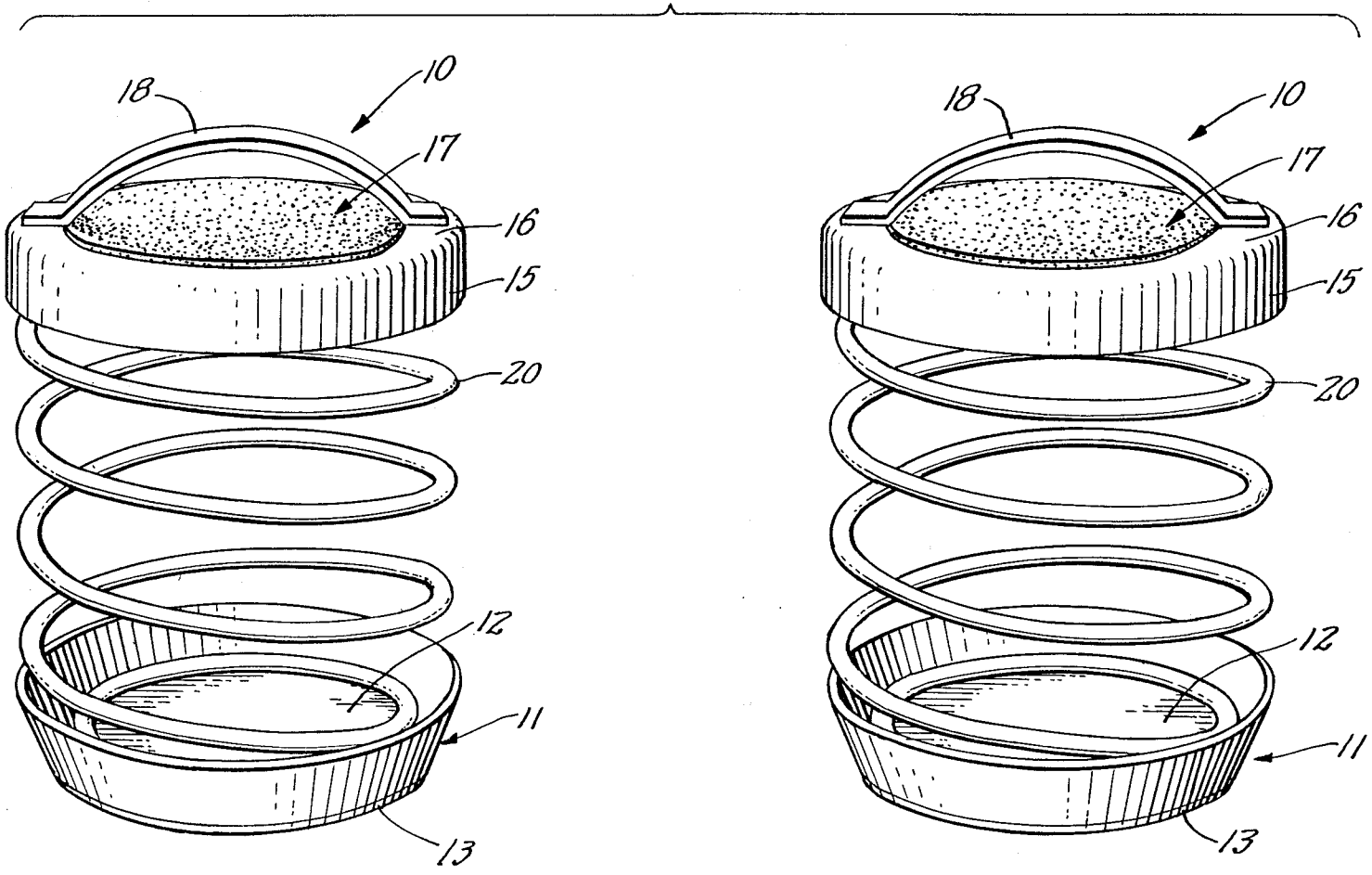
FIG. 1 is a perspective view of a pair of hand-engageable body-supporting spring-biased exercise units embodying the principles of the invention.

Referring now to the drawing, an identical pair of generally cylindrical exercise units 10, one to be engaged by each hand of the user, comprises the exercise apparatus of the invention. The invention will be described with reference to the structure of one of the pair of exercise units 10, although the pair itself comprises the apparatus of the invention since it is employed by supporting both arms of the user.

The exercise unit 10 is comprised essentially of three fundamental elements. A thermoplastic dish-shaped, frustoconical base element 11 having a flat bottom 12 to which a nonskid rubber or other frictional pad 13 is adhered. An upper, generally cylindrical thermoplastic cap 15 having a dome-shaped central region 16 covered by a non-slip, absorbent fabric, e.g., terry cloth, or leather hand pad 17. A hand strap 18 bisects the cap 15 and is adhered at peripheral edges thereof by suitable epoxy adhesive or mechanical fasteners (not shown). A heavy duty, steel coil spring 20 is mounted securely between the cap 15 and base element 11, either by being threaded into integral internal threads (not shown) formed on the internal surfaces of the thermoplastic elements 11, 15 or by a suitable force-fit mechanical connection, or bonding by epoxy-type adhesive.

Advantageously, the coil spring is of 3/16" diameter wire and has a 6" diameter, a height of 6", and six coils, although it is to be understood that slight variations in the specifications of the spring are within the parameters of the invention for making the device more or less resilient for a specific application. However, it has been determined that the aforementioned spring specifications are satisfactory for providing the requisite bias for a large percentage of the exercising population. Of course, for children, handicapped persons or others not possessing average strength, the spring characteristics will be weaker; similarly, for those who are above average strength, the spring characteristics will be stronger to provide greater resistance.

In use, the pair of exercise units 10 are placed on the floor in tandem and spaced apart in a manner such that. a person doing otherwise conventional push-ups will place his hands on the doe surface 16 between the hand strap 18 and the hand pad 17 prior to commencing push-up exercises. When performing push-ups with the exercise device, as mentioned hereinabove, a bouncing effect is achieved and enhanced exercise is possible, with resultant benefits in terms of muscle development and muscle tone and the like. Another exercise, in lieu of doing push-ups against the floor, entails grasping the exercise units 10 and leaning against a wall for performing vertical push-up type exercises by pushing in and out against the units and a wall. The spring force will provide a bouncing, back and forth action, as will be understood.

While the above described exercising apparatus has been made by way of illustrating the inventive principles, it has been given by way of example only. Accordingly, reference should be made to the following appended claims in determining the full scope of the present invention.

I claim:

1. An exercise apparatus comprising a pair of hand engageable, springbiased exercise units, each comprising:

(a) a thermoplastic base element in the form of a frusto-conical dish;

(b) a thermoplastic cap element having a dome-shaped hand-engaging surface;

(c) said base element including a non-skid surface adhered to the bottom thereof;

(d) a steel coil spring secured between said base member and said cap member; and (e) a hand strap traversing said cap member and being secured to peripheral edges thereof whereby said exercise device will support the arms of an exerciser during exercising and will provide a bouncing force to said exerciser upon the periodic compression and return of said coil spring.

2. An exercise device in accordance with claim 1 further characterized, in that:

(a) said dome surface is covered by a leather or fabric layer to enhance the support of the hand of the exerciser thereagainst.

3. An exercise apparatus comprising a pair of hand engageable, springbiased exercise units, each comprising:

(a) a thermoplastic base element in the form of a frusto-conical dish;

(b) a thermoplastic cap element having a dome-shaped hand-engaging surface;

(c) a steel coil spring secured between said base member and said cap member;

(d) said spring being approximately six inches in diameter, approximately six inches in height, and having approximately six coils; and (e) a hand strap traversing said cap member and being secured to peripheral edges thereof whereby said exercise device will support the arms of an exerciser during exercising and will provide a bouncing force to said exerciser upon the periodic compression and return of said coil spring;

4. An exercise device in accordance with claim 3 further characterized, in that:

(a) said dome surface is covered by a leather or fabric layer to enhance the support of the hand of the exerciser thereagainst.

* * * * *